US008366847B2

(12) United States Patent
Yamamoto et al.

(10) Patent No.: US 8,366,847 B2
(45) Date of Patent: Feb. 5, 2013

(54) PERCHLORATE-FREE YELLOW SIGNAL FLARE COMPOSITION

(75) Inventors: Christina M. Yamamoto, Bloomington, IN (US); Robert G. Shortridge, Bloomfield, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 224 days.

(21) Appl. No.: 13/007,188

(22) Filed: Jan. 14, 2011

(65) Prior Publication Data

US 2011/0139322 A1 Jun. 16, 2011

Related U.S. Application Data

(62) Division of application No. 12/334,101, filed on Dec. 12, 2008.

(60) Provisional application No. 61/075,647, filed on Jun. 25, 2008.

(51) Int. Cl.
*D03D 23/00* (2006.01)

(52) U.S. Cl. ..... 149/109.6; 149/61

(58) Field of Classification Search ..... 149/61, 149/109.6

See application file for complete search history.

(56) References Cited

U.S. PATENT DOCUMENTS

| | | | | |
|---|---|---|---|---|
| 3,411,963 | A | | 11/1968 | Douda |
| 3,499,385 | A | | 3/1970 | Douda |
| 3,690,972 | A | | 9/1972 | Kaye et al. |
| 3,736,206 | A | * | 5/1973 | Dinsdale et al. ..... 156/293 |
| 3,911,823 | A | | 10/1975 | Murray et al. |
| 3,954,529 | A | | 5/1976 | Reed et al. |
| 3,983,816 | A | | 10/1976 | Cornia et al. |
| 4,078,954 | A | | 3/1978 | Bernardy |
| 4,164,186 | A | | 8/1979 | Beatty et al. |
| 4,184,901 | A | | 1/1980 | Tanner, Jr. et al. |
| 4,204,895 | A | | 5/1980 | Webster, III |
| 4,341,573 | A | | 7/1982 | Donoho |
| 4,768,439 | A | | 9/1988 | Singer et al. |
| 4,812,180 | A | | 3/1989 | Sayles |
| 5,056,435 | A | | 10/1991 | Jones et al. |
| 5,061,409 | A | * | 10/1991 | Dillehay ..... 264/3.3 |
| 5,071,497 | A | | 12/1991 | Hassell et al. |
| 5,561,260 | A | | 10/1996 | Towning et al. |
| 5,565,150 | A | | 10/1996 | Dillehay et al. |
| 5,585,594 | A | | 12/1996 | Pelham et al. |
| 5,801,321 | A | * | 9/1998 | LaGrange et al. ..... 102/336 |
| 5,917,146 | A | | 6/1999 | Hiskey et al. |
| 6,092,467 | A | | 7/2000 | Brice |

(Continued)

FOREIGN PATENT DOCUMENTS

| | | | |
|---|---|---|---|
| DE | 102005053849 | A1 | 5/2007 |
| GB | 1284499 | A | 8/1972 |

(Continued)

OTHER PUBLICATIONS

Shortridge et al., Elimination of Perchlorate Oxidizers from Pyrotechnic Flare Compositions, Final Technical Report WP-1280, authorized for public release on or after Apr. 24, 2008, 65 pgs. Crane, Indiana.

(Continued)

*Primary Examiner* — Aileen B Felton
(74) *Attorney, Agent, or Firm* — Christopher A. Monsey

(57) ABSTRACT

Perchlorate-free flare compositions are disclosed which, when burned, produce yellow smoke and flames. Methods of producing the compositions are also disclosed.

7 Claims, 3 Drawing Sheets

U.S. PATENT DOCUMENTS

| | | | |
|---|---|---|---|
| 6,174,391 | B1 | 1/2001 | Chen et al. |
| 6,214,139 | B1 | 4/2001 | Hiskey et al. |
| 6,263,797 | B1 | 7/2001 | Brice |
| 6,312,537 | B1 | 11/2001 | Hiskey et al. |
| 6,312,625 | B1 | 11/2001 | Nielson et al. |
| 6,315,847 | B1 | 11/2001 | Lee et al. |
| 6,432,231 | B1 | 8/2002 | Nielson et al. |
| 6,530,327 | B2 | 3/2003 | Hiskey et al. |
| 6,599,379 | B2 | 7/2003 | Hiskey et al. |
| 2002/0148540 | A1 | 10/2002 | Hiskey et al. |
| 2007/0068610 | A1 | 3/2007 | Nickel |

FOREIGN PATENT DOCUMENTS

| | | |
|---|---|---|
| GB | 1520601 A | 8/1978 |
| GB | 2044748 | 10/1980 |
| WO | WO 00/44689 | 8/2000 |

OTHER PUBLICATIONS

Shortridge, Robert, Elimination of Perchlorate Oxidizers From Pyrotechnic Flare Compositions, Weapons Systems and Platforms WP-1280, Nov. 2006, 1 pg., Crane, Indiana.

Webster, et al., Flares Containing Calcium Nitrate as an Oxidizer, U.S. Department of Commerce, National Technical Information Service, May 31, 1976, 40 pgs, Crane, Indiana.

Conkling, John A., Chemistry of Pyrotechnics, Basic Principles and Theory, 1985, Marcel Dekker, Inc., 85 pgs. New York, New York.

Halford, Bethany, Pyrotechnics for the Planet—Chemists Seek Environmentally Friendlier Compounds and Formulations for Fireworks and Flares, Chemical & Engineering News, Jun. 30, 2008, pp. 14-18, vol. 86, No. 26.

Smith, Tom, "Assessing the Risks—Suggestions for a Consistent Semi-Quantified Approach", Journal of Pyrotechnic, Winter 2003, 11 pgs.

Shortridge et al, Elimination of Perchlorate Oxidizers from Pyrotechnic Flare Compositions, ESTCP 07E-WP3-021, Navsea Warfare Centers, Dec. 2007, 1 pg., Crane, Indiana.

Shortridge et al. Development and Testing of Perchlorate-Free Red and Green Pyrotechnic Flare Compositions, Department of Mechanical Engineering, New Jersey Institute of Technology, Newark NJ, Jul. 16, 2006, 10 pgs., Crane, Indiana.

Evans, Robert W, "Comments concerning the production of light by visual flares", Chemical Abstracts Service, Columbus, OH, US, Apr. 22, 2001.

Webster, Henry A, "Visible Spectra of Standard Navy Colored Flares", Propellants, Explosives, Pyrotechnics Feb. 1985, vol. 10, No. 1.

Singh, S. N. et al, "A study on magnesium and sodium nitrate based illumination compositions containing different binders", Chemical Abstracts Service, Columbus, OH, US, Mar. 17, 1998.

Wilkin, R. T. et al, "Perchlorate behavior in a municipal lake following fireworks displays", Environmental Science and Technology, American Chemical Society, Easton, PA, US, vol. 41, No. 11, Jun. 1, 2007.

International Search Report and Written Opinion for PCT Application No. PCT/US2009/048587 issued by the International Search Authority on Mar. 1, 2010.

Russel, Michael, The Chemistry of Fireworks, Royal Society of Chemistry, 2000, 132 pgs.

* cited by examiner

PERCHLORATE-FREE YELLOW SIGNAL FLARE COMPOSITION

CROSS-REFERENCE TO RELATED APPLICATIONS

This application is a divisional of U.S. patent application Ser. No. 12/334,101, filed Dec. 12, 2008 which claims the benefit of U.S. Provisional Application No. 61/075,647, filed Jun. 25, 2008, both of which are hereby expressly incorporated by reference.

STATEMENT REGARDING FEDERALLY SPONSORED RESEARCH OR DEVELOPMENT

The invention described herein was made in the performance of official duties by employees of the Department of the Navy and may be manufactured, used, licensed by or for the United States Government for any governmental purpose without payment of any royalties thereon.

BACKGROUND

The present disclosure relates to approaches for reformulating a variety of yellow pyrotechnic compositions so as to limit environmentally objectionable perchlorate ingredients while still providing acceptable performance when compared to in-service signal flare devices.

Pyrotechnics are used in a variety of applications. One such application is colored signal flares. Many such pyrotechnic flare compositions include chlorate or perchlorate oxidizers. Residual perchlorates from these devices may be absorbed into groundwater and require remediation.

In the past, the vast majority of red, green, and yellow signal flares have used perchlorate ingredients to produce their desired colors. This has contributed to an increase in the total concentration of perchlorate residues at various sites, such as military and industrial sites, and to generally higher than desired concentration in drinking water supplies. Clearly, any methods that can be used to limit the perchlorates and minimize any other chlorine-containing ingredients would be an environmentally noteworthy advance in the state of the art.

The U.S. Navy has had an in-service yellow flare perchlorate-containing composition (IS Y 1). IS Y 1 has had a product improvement replacement, the Yellow signal flare (IS Y 2). IS Y 2 uses the same composition as IS Y 1. As shown in Table 5, IS Y 2 contains approximately thirty point three weight percent (30.3%) Granulation 18 magnesium fuel, approximately nineteen point eight weight percent (19.8%) sodium oxalate, approximately twenty weight percent (20%) barium nitrate, approximately twenty-one weight percent (21%) potassium perchlorate, approximately four weight percent (4%) asphaltum, and approximately five weight percent (5%) binder. The binder includes within the range of approximately seventy percent (70%) to approximately eighty percent (80%) Epon™ Resin 813 epoxy and within the range of approximately twenty percent (20%) to approximately thirty percent (30%) Versamid® 140 curing agent. Accordingly, it was this composition that formed the starting point in the new perchlorate-free yellow signal flare formulations disclosed in the present patent.

SUMMARY

The present disclosure includes a flare composition for producing a yellow flame, the composition comprising, by weight, a magnesium fuel within the range of approximately eighteen percent (18%) to approximately thirty percent (30%) of the composition, the magnesium fuel including particles sizes selected from the group consisting of granulation 15, granulation 17, granulation 18, and mixtures thereof, a magnesium-aluminum alloy within the range of approximately zero percent (0%) to approximately five percent (5%) of the composition, a sodium nitrate within the range of approximately eighteen percent (18%) to approximately thirty-eight percent (38%) of the composition, a barium nitrate within the range of approximately twenty-six percent (26%) to approximately thirty-six percent (36%) of the composition, a polyvinyl chloride within the range of approximately seven percent (7%) to approximately twelve percent (12%) of the composition, an asphaltum within the range of approximately zero percent (0%) to approximately five percent (5%) of the composition, and a two-part curable binder system within the range of approximately four percent (4%) to approximately seven point five percent (7.5%) of the composition, the binder system including within the range of approximately seventy percent (70%) to approximately eighty percent (80%) epoxy and within the range of approximately twenty percent (20%) to approximately thirty percent (30%) curing agent.

A method of producing a flare composition, the method comprising the steps of: mixing magnesium within the range of approximately eighteen weight percent (18%) to approximately thirty weight percent (30%) of the composition, a magnesium-aluminum alloy within the range of zero weight percent (0%) to approximately five weight percent (5%) of the composition, sodium nitrate within the range of approximately eighteen percent (18%) to approximately thirty-eight percent (38%) of the composition, barium nitrate within the range of approximately twenty-six percent (26%) to approximately thirty-six percent (36%) of the composition, polyvinyl chloride within the range of approximately seven percent (7%) to approximately twelve percent (12%) of the composition, asphaltum within the range of approximately zero percent (0%) to approximately five percent (5%) of the composition and a two-part curable binder system within the range of approximately four weight percent (4%) to approximately seven point five weight percent (7.5%) of the composition, wherein magnesium includes particles sizes selected from the group consisting of granulation 15, granulation 17, granulation 18, and mixtures thereof, wherein the binder system includes within the range of approximately seventy percent (70%) to approximately eighty percent (80%) epoxy and within the range of approximately twenty percent (20%) to approximately thirty percent (30%) curing agent, blending sodium nitrate within the range of approximately eighteen weight percent (18%) to approximately thirty-eight weight percent (38%) of the composition, barium nitrate within the range of approximately twenty-six weight percent (26%) to approximately thirty-six weight percent (36%) of the composition, and polyvinyl chloride within the range of approximately seven weight percent (7%) to approximately twelve weight percent (12%) of the composition, mixing the sodium nitrate, barium nitrate, and polyvinyl chloride mixture to the binder system coated magnesium mixture in a mixing bowl to provide the composition, and wiping the sides of the mixing bowl, screening the composition, aging the composition for a period of time, and pressing the composition into the flare composition.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Figure 1:
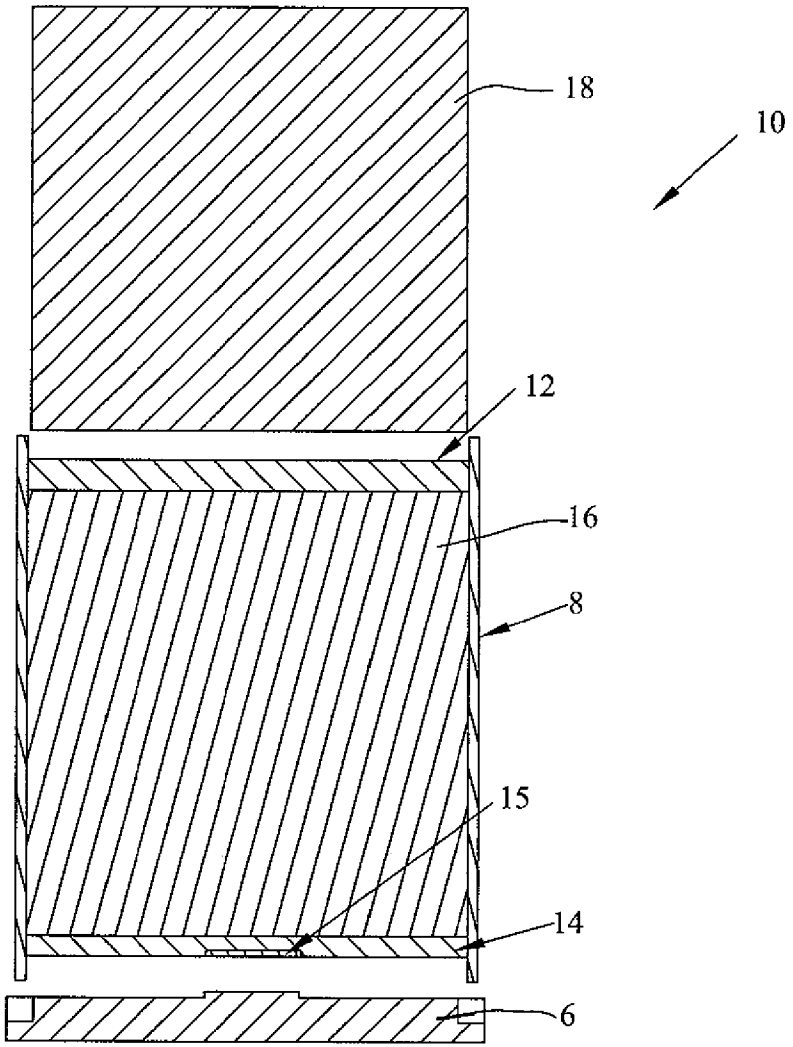
FIG. 1 is a schematic illustration of an illustrative embodiment of a signal flare in an inverted orientation for pressing by a ram.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE EXEMPLARY EMBODIMENTS

The embodiments disclosed below are not intended to be exhaustive or limit the invention to the precise forms disclosed in the following detailed description. Rather, the embodiments are chosen and described so that others skilled in the art may utilize their teachings.

In the present disclosure, perchlorate oxidizers currently used in various in-service flare compositions are substituted with nitrate or other less energetic oxidizers. Because these oxidizers are less reactive than those that include perchlorate, high-energy fuels are used to make up for the loss in energy.

Specifically, compositions and methods are disclosed in which perchlorate-free pyrotechnic compositions are prepared for use as linear burning, 0.75-inch diameter, free-standing laboratory scale yellow signal flare candles. It is intended that these perchlorate-free flare candles be prepared in such a way to produce either equal or superior luminous intensities, burn times, dominant wavelengths, and color purities when compared with the in-service perchlorate-containing compositions.

Numerous perchlorate-free yellow flare compositions of the present disclosure are mixed, pressed and function tested at laboratory scale. The compositions may be initially pressed into laboratory scale pellets in order to fine tune the burn rates and luminous intensity output. Compositions may then be scaled to concept scale yellow flare candles, such as 1.2-inch diameter linear burning prototype scale yellow flare candles pressed into fish paper tubes 8 (FIG. 1).

As shown in FIG. 1, flare candle 10 includes a bottom layer of approximately 3 to approximately 5 grams of inert fireclay composition 12, and a top layer of approximately 2.5 grams of ignition composition 14, on top of which ignition slurry 15 is painted in order to aid in ignition transfer. Typically inert fireclay composition 12 is a separate composition for safety purposes and for thermal insulation to prevent flare candle 10 from igniting any smoke portion created during operation of flare candle 10. Ignition composition 14 is added as a top layer to assist in ignition of flare candle 10.

As discussed in greater detail below, flare candle 10 also includes perchlorate-free pyrotechnic composition 16. To enhance the safety of the pellet pressing operation, flare candle 10 is pressed in an upside down orientation so that moving upper ram 18 comes in direct contact only with inert fireclay composition layer 12 and that base of press 6 comes in to contact with ignition composition 14. Pressed flare candles 10 are then subjected to performance testing in a photometric tunnel. Flare candles 10 are illustratively tested in an upside down orientation with a 12-14 mph airflow in order to aid in smoke removal. Flare candles 10 may then be subjected to the same flare performance testing as were the Navy's Yellow signal flare (IS Y 2) perchlorate-containing yellow standard composition.

More specifically, the perchlorate-free yellow formulations of the present disclosure may include from approximately 18% to approximately 30%, percent by weight, of magnesium which may be any one of or combination of Granulation 15 (GR 15), Granulation 17 (GR 17) and Granulation 18 (GR 18). Materials including magnesium are known to take several forms, such as powder, atomized, and amorphous flakes. In one embodiment of the present disclosure, the magnesium source is atomized.

In Table 1, granulation numbers 15, 17, and 18, among others, are described in greater detail. In Table 2, granulation requirements for granulation numbers 15, 17, and 18, among others, are described in greater detail. Tables 1 and 2 are from the American Society for Testing and Materials document MIL-DTL-382D, the subject matter of which is expressly incorporated by reference.

TABLE 1

American Society for Testing and Materials (ASTM) Granulation Numbers

| Granulation | Nominal Mesh Size | |
|---|---|---|
| Number | Metric | U.S. |
| 1 | 425 μm-180 μm | 40-80 |
| 2 | 425 μm-180 μm | 40-80 (alternate) |
| 3 | 300 μm-150 μm | 50-100 |
| 4 | 300 μm-150 μm | 50-100 (Army) |
| 5 | 300 μm-125 μm | 50-120 |
| 6 | 180 μm-125 μm | 80-120 |
| 7 | 150 μm | 100 |
| 8 | 125 μm-75 μm | 120-200 |
| 9 | 106 μm | 140 |
| 10 | 75 μm | 200 |
| 11 | 180 μm-75 μm | 80-200 |
| 12 | 125 μm-75 μm | 120-200 (Army) |
| 13 | 850 μm-300 μm | 20-50 |
| 14 | 300 μm-150 μm | 50-100 |
| 15 | 150 μm-75 μm | 100-200 |
| 16 | 75 μm-45 μm | 200-325 |
| 17 | 300 μm-150 μm | 50-100 |
| 18 | 600 μm-300 μm | 30-50 |

TABLE 2

American Society for Testing and Materials (ASTM) Granulation requirements[1].

| Granulation | Max Sieve Metric (U.S.) | Percent Pass | Min Sieve Metric (U.S.) | Percent Pass | Density[2] (gm/ml) Max | Density[2] (gm/ml) Min |
|---|---|---|---|---|---|---|
| 1 | 600 μm (No. 30) | 100% | 180 μm (No. 80) | 15% | 0.65 | 0.55 |
| 2 | 300 μm (No. 50) | 90% | 180 μm (No. 80) | 5% | 0.65 | 0.55 |
| 3 | 600 μm (No. 30) | 10% | 150 μm (No. 100) | 15% | 0.75 | 0.65 |
| 4 | 850 μm (No. 20) | 100% | 150 μm (No. 100) | 12% | 0.625 | 0.45 |
| 5 | 425 μm (No. 40) | 100% | 125 μm (No. 120) | 10% | — | — |
| 6 | 212 μm (No. 70) | 100% | 125 μm (No. 120) | 10% | — | — |
| 7 | 150 μm (No. 100) | 98% | — | — | — | — |
| 8 | 250 μm (No. 60) | 100% | 75 μm (No. 200) | 10% | — | — |
| 9 | 125 μm (No. 120) | 98% | 75 μm (No. 200) | 0% | — | — |
| 10 | 125 μm (No. 120) | 100% | 75 μm (No. 200) | 90-100% | — | — |
| 11 | 710 μm (No. 25) | 100% | 75 μm (No. 200) | 25% | — | — |
| 12 | 150 μm (No. 100) | 100% | 75 μm (No. 200) | 85% | — | 0.45 |
| 13 | 3.35 mm (No. 6) | 100% | 300 μm (No. 50) | 5% | — | 0.45 |
| 14 | 300 μm (No. 50) | 90% | 150 μm (No. 100) | 15% | — | 0.70 |
| 15 | 300 μm (No. 50) | 100% | 75 μm (No. 200) | 15% | 0.75 | 0.65 |
| 16 | 75 μm (No. 200) | 96% | 4 μm (—) | 0% | — | 0.62 |
| 17 | 600 μm (No. 30) | 100% | 150 μm (No. 100) | 15% | — | 0.90 |
| 18 | 1.18 mm (No. 16) | 99% | 212 μm (No. 70) | 1% | — | 0.90 |

[1]All percentages shall be by weight using sieves conforming to ASTM E 11, "Standard Specification for Wire-Cloth Sieves for Testing Purposes." The powder shall pass through the required sieves readily without balling or the particles clinging together.
[2]Density of the magnesium powder is determined in accordance with ASTM B 329, "Standard Test Method for Apparent Density of Refractory Metals and Compounds by the Scott Volumeter."

MIL-DTL-382D describes the process for measuring the granulation units described in Tables 1 and 2. Specifically, MIL-DTL-382D states to place a weighed portion of approximately 50 g of the sample on the top sieve of a nest of sieves assembled as specified in Table 2 and provide with a bottom pan. Cover and shake for 30 minutes in a mechanical shaker geared to produce 300±15 gyrations and 150±10 taps of the striker per minute. Weigh the portions retained by each sieve and calculate to a percentage as required.

The perchlorate-free yellow formulations of the present disclosure may include from approximately zero percent (0%) to approximately five percent (5%) of commercial Mg—Al alloy. During these preparations, commercial Mg—Al alloy may be produced using Mechanical Alloying technology. Mechanical Alloying is a dry, high energy ball milling process in which an initial blend of powders is repeatedly kneaded together and re-fractured by the action of the ball-powder collisions. Mechanical Alloying usually produces a powder in which each particle has content similar to that of the initial blend of powders. Mechanical Alloy particles are chemically homogenous to at least the one hundred nanometer (100 nm) level. That is the particles are composed of alloy particles rather than agglomerated clusters of the constituent starting materials comprising the initial blend of powders.

The perchlorate-free flare compositions of the present disclosure may not include either the hygroscopic calcium nitrate or the environmentally objectionable potassium perchlorate ingredients. Rather the perchlorate-free yellow formulations of the present disclosure may include from approximately eighteen percent (18%) to approximately thirty-eight percent (38%) of sodium nitrate, from approximately twenty-six percent (26%) to approximately thirty-six percent (36%) of barium nitrate, from approximately seven percent (7%) to approximately twelve (12%) of polyvinyl chloride, from approximately zero percent (0%) to approximately five percent (5%) of asphaltum, and from approximately four percent (4%) to approximately seven point five percent (7.5%) of a two-part curable binder system including Epon™ Resin 813 epoxy and Versamid® 140 curing agent. Epon™ Resin 813 is a low viscosity liquid bisphenol-A based epoxy resin diluted with cresyl glycidyl ether. Epon™ Resin 813 is available through Hexion Speciality Chemicals of Houston, Tex. (www.hexion.com). Versamid® 140 is a medium low viscosity reactive polyamide resin based on dimerized fatty acid and polyamindes. Versamid® 140 is available through Cognis of Cincinnati, Ohio (www.cognis.com). These compositions may be originally studied at laboratory scale, and are then scaled to the same 24-gram flare form factor. These compositions are then subjected to flare performance testing.

Figure 2:
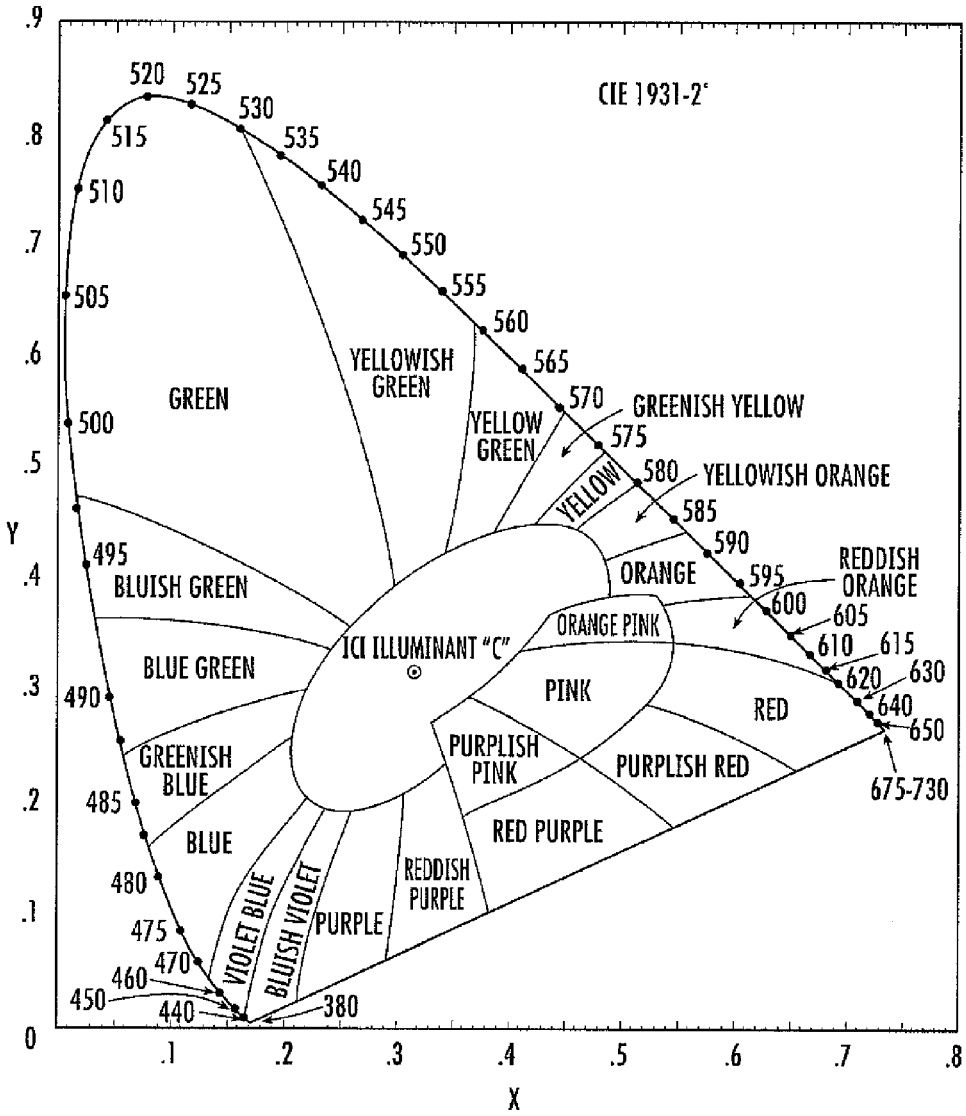
FIG. 2 is a representation of a Chromaticity Diagram.

During these tests, the luminous intensities are measured with a candlepower meter (also known as candelas (cd)), and a Tri-Stimulus colorimeter may be used to obtain X-bar, Y-bar and Z-bar color coordinates from which the dominant wavelength and the color purity may be obtained using the well-known Chromaticity Diagram as illustrated in FIG. 2. Each of the three colorimeters in this device is filtered so that it records the emission intensity of the flare versus time in one of three spectral regions in the visible spectrum. The X-bar, Y-bar and Z-bar coordinates are obtained when the ratios of the integrated intensity from each colorimeter is divided by the total intensity from all three colorimeters. The X-bar and Y-bar coordinates are then located on the Chromaticity Diagram and a straight line is drawn through that point and the "white light" point at approximately X-bar=0.310, Y-bar=0.316. The dominant wavelength is found at the point this line intersects with the nearest axis of the Chromaticity Diagram. The color purity is calculated as the percentage corresponding to the fraction that is formed by dividing the distance between the white light point and the measured X,Y point by the distance between the white light point and the intersection of the line with the axis of the Chromaticity Diagram.

In these tests the luminous intensities substantially exceeded those of the in-service perchlorate-containing IS Y 2 yellow flares that were used as comparison standards. With these higher intensities the perchlorate-free compositions of the present disclosure may beneficially increase the burn time of the yellow signal flares while still meeting all flare performance specifications for luminous intensity, dominant wavelength and color purity. A longer and brighter burning signal such as this should beneficially increase the likelihood that a signal being burned could be spotted.

Table 3 shows the chemical compositions of the standard composition, as well as three perchlorate-free embodiments that are based upon the predictions for optimum performance of the NASA-Lewis Chemical Equilibrium Program. Also included in Table 3 are predicted adiabatic combustion temperatures and mass fractions of the combustion products.

TABLE 3

Perchlorate-Free Yellow Flare Compositions. Predicted Temperatures and Mass Fractions of Combustion Products - Yellow Signal Flare Compositions

| Ingredient | IS Y 2-Std | YSF-1 | YSF-3 | YSF-8 |
|---|---|---|---|---|
| Mg | 30.30 | 28.10 | 23.00 | 20.10 |
| Mg—Al | 0 | 0 | 3.60 | 0 |
| $NaNO_3$ | 0 | 20.00 | 26.10 | 37.00 |
| $Na_2C_2O_4$ | 19.80 | 0 | 0 | 0 |
| $Ba(NO_3)_2$ | 20.00 | 34.10 | 29.00 | 27.05 |
| $KClO_4$ | 21.00 | 0 | 0 | 0 |
| PVC | 0 | 8.90 | 8.10 | 10.90 |
| Asphaltum | 3.95 | 3.95 | 3.95 | 0 |
| Epon 813 | 3.47 | 3.47 | 3.47 | 3.47 |
| Versamid 140 | 1.48 | 1.48 | 1.48 | 1.48 |
| Predicted | Combustion | Products | | |
| T °K | 1986 | 2349 | 2156 | 2813 |
| Na | 0.0595 | 0.0766 | 0.1019 | 0.1165 |
| BaCl | 0.0358 | 0.0590 | 0.0577 | 0.0066 |
| BaOH | 0.0377 | 0.0148 | 0.0055 | 0.0147 |
| BaO | 0.0254 | 0.0237 | 0.0053 | 0.1096 |
| MgO(cr) | 0.3486 | 0.2842 | 0.2322 | 0.2914 |
| KCl | 0.0185 | 0 | 0 | 0 |
| Toxics | | | | |
| NaCN | 0.00976 | 0.000057 | 0.00106 | 0 |
| KCN | 0.00699 | 0 | 0 | 0 |
| HCN | 0.00045 | 0.0000095 | 0.000077 | 0 |

Table 3 reveals that the substitution of sodium nitrate for sodium oxalate, and the removal of the potassium perchlorate with corresponding increases in the percentages of barium nitrate and polyvinyl chloride, is predicted to have a number of benefits for the performance of the yellow signals. These include higher concentrations of emitting sodium atoms (Na), as well as higher concentrations of green emitting species such as BaCI and BaOH radicals, and higher predicted combustion temperatures. Furthermore, the new compositions are predicted to have the added environmental benefit of either drastically reducing or eliminating the toxic cyanide combustion products such as hydrogen cyanide (HCN), potassium cyanide (KCN) and sodium cyanide (NaCN).

A total of three performance test series were performed on 15-gram laboratory scale flare candles made from these three perchlorate-free yellow flare compositions, together with the perchlorate-containing in-service IS Y 2 yellow flare composition for comparison purposes. The first test series included only the larger particle Granulation 18 magnesium fuel. Table 4 presents the measured burn times, Candle Power luminous intensities, dominant wavelengths, and color purities from the first test series. The second test series included only the smaller particle Granulation 15 magnesium fuel. Table 5 presents the measured burn times, Candle Power luminous intensities, dominant wavelengths, and color purities from the second test series.

TABLE 4

Granulation 18 - Larger Magnesium Particles Lab Scale Performance Test Results for Perchlorate-Free Yellow Signal Flare Compositions

| Flare | # Flares Averaged | Color Purity % | Dominant Wave-length | Candle Power, cd | Burn Time, s | Scale Up? |
|---|---|---|---|---|---|---|
| IS Y 2 | 6 | 78.3 | 587 nm | 1199 | 41 | Std |
| YSF-1 | 6 | 77.3 | 583 nm | 1442 | 51 | Yes |
| YSF-3 | 6 | 78.4 | 585 nm | 1357 | 52 | Yes |
| YSF-8 | 6 | 75.3 | 583 nm | 1571 | 59 | Yes |

TABLE 5

Granulation 15 - Smaller Magnesium Particles Lab Scale Performance Test Results for Perchlorate-Free Yellow Signal Flare Compositions

| Flare | # Flares Averaged | Color Purity % | Dominant Wave-length | Candle Power, cd | Burn Time, s | Scale Up? |
|---|---|---|---|---|---|---|
| YSF-1 | 3 | 89 | 582 nm | 2140 | 26 | Yes |
| YSF-3 | 3 | 90 | 584 nm | 2630 | 26 | Yes |
| YSF-8 | 3 | 87 | 582 nm | 3805 | 26 | Yes |

As expected, decreasing the particle size resulted in much faster burn rates with proportionately increased luminous intensities. As shown in Table 4, the in-service flare composition on average burned in approximately 41 seconds. It is noted from Table 4 that the perchlorate-free compositions of the present disclosure with Granulation 18 magnesium burned on average within the range of approximately 51 seconds to approximately 59 seconds. The perchlorate-free compositions of the present disclosure with Granulation 18 magnesium also had a beneficially higher luminous intensity.

The in-service IS Y 2 compositions was observed to burn slightly faster than the perchlorate-free compositions of the present disclosure with Granulation 18 magnesium, but significantly slower than the perchlorate-free compositions of the present disclosure with Granulation 15 magnesium. It is noted from Table 5 that the perchlorate-free compositions of the present disclosure with Granulation 15 magnesium burned on average in approximately 26 seconds. Accordingly, it is postulated that an optimized mixture of the two granulations could be identified that would more closely match the burn times of the perchlorate-free compositions of the present disclosure with that of the in-service composition.

The perchlorate-free compositions of the present disclosure with Granulation 15 magnesium also had a significantly higher, beneficially higher, luminous intensity. The in-service IS Y 2 compositions was observed to provide approximately 1199 candelas. It is noted from Table 5 that the perchlorate-free composition of the present disclosure with Granulation 15 magnesium provided within the range of approximately 2140 candelas to approximately 3805 candelas.

Such compositions were tested in the third test series and the performance test results are summarized in Table 6. Observations reveal that the flare plumes of the perchlorate-free compositions definitely appear more yellow in color than the perchlorate-containing IS Y 2 standard composition which appears more "orange-yellow" in color. These visual observations correlate well with the slightly shorter dominant wavelength values produced by the perchlorate-free compositions compared with the longer dominant wavelengths produced by the IS Y 2 standard composition.

TABLE 6

Lab Scale Performance Test Results for Perchlorate-Free Yellow Signal Flare Compositions with a Combination of Magnesium Particle Size Granulations

| Composition | #Tested | Magnesium Granulation | % Color Purity | Dominant Wavelength, nm | Candle Power, cd | Burn Time, sec |
|---|---|---|---|---|---|---|
| YSF-1 | 3 | 60/40 GR 15/GR 18 | 86 | 578 | 1648 | 26 |
| YSF-3 | 3 | 60/40 GR 15/GR 18 | 89 | 579 | 2152 | 32 |
| YSF-8 | 3 | 60/40 GR 15/GR 18 | 84 | 578 | 2662 | 34 |
| IS Y 2 STD | 3 | GR 18 | 89 | 581 | 1525 | 38 |

All three optimized perchlorate-free compositions of Table 6 produce significantly higher luminous intensities than the IS Y 2 standard composition. This should remain true even if a slightly higher percentage of Granulation 18 magnesium is used to adjust the burn times of the perchlorate-free compositions to that of the in-service composition at 38 seconds. Also, all of the perchlorate-free compositions meet the IS Y 2 flare performance specifications calling for dominant wavelengths from 575-593 nm and a minimum color purity of 77%.

Tailoring of the burn time of these perchlorate-free yellow flares can be accomplished by changes in the magnesium particle size distribution. It is also postulated that tailoring the burn time can be accomplished by variation of the fuel to oxidizer (F/O) ratio of the composition and variation of the weight percentage of the epoxy binder system. From the trends exhibited in the above tables, the burn time of the flare candle can readily be tailored over a fairly wide range.

Figure 3:
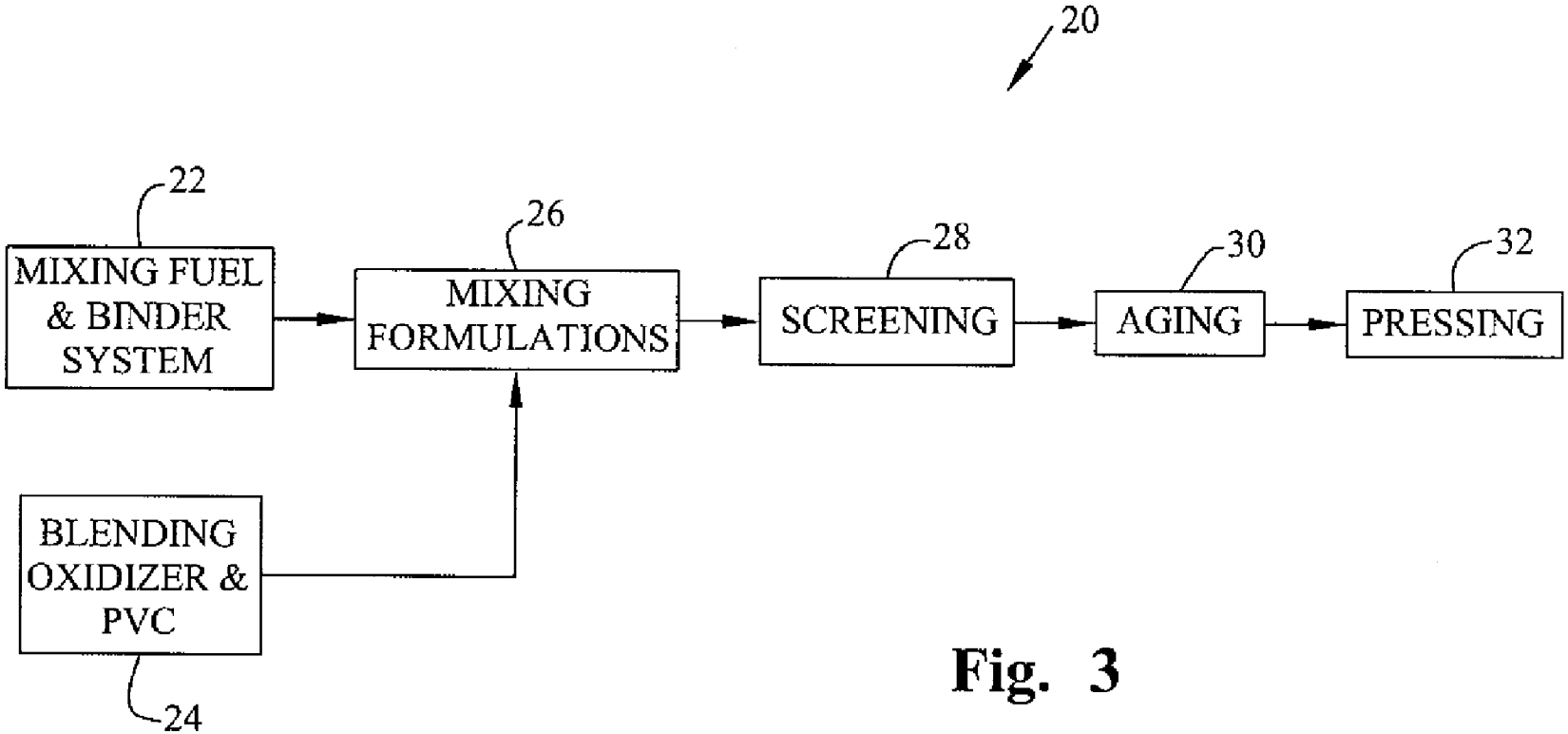
FIG. 3 is a schematic illustration of a flow chart illustrative of preparing the signal flare composition.

As shown in FIG. 3, illustrative manufacturing process 20 includes the step of mixing 22 magnesium, optionally including magnesium-aluminum, with the two-part curable binder system. In one embodiment, the sides of the mixing bowl are wiped with a non-sparking spatula during the course of the mixing process of step 22. For example, magnesium and the two-part curable binder system are mixed for five minutes (5 min). This action may be followed by wiping the sides of the mixing bowl with a non-sparking spatula. The substeps of mixing and wiping may be repeated two (2) to approximately four (4) times.

Manufacturing process 20 also includes the step of blending 24 sodium nitrate, barium nitrate, and polyvinyl chloride, and optionally including asphaltum. In one embodiment, sodium nitrate, barium nitrate, and polyvinyl chloride, and optionally including asphaltum are placed on either a Standard No. 16 or No. 30 sieve. With a cotton mitt, the ingredients are hand worked through the sieve onto a bottom pan. This action may be repeated approximately three (3) times.

The next step of manufacturing process 20 includes mixing 26 portions of mix 22 with portions of blend 24. In one embodiment, the sides of the mixing bowl are wiped with a non-sparking spatula during the course of the mixing process of step 26. For example, portions of mix 22 and blend 24 are mixed for five minutes (5 min). This action may be followed by wiping the sides of the mixing bowl with a non-sparking spatula. The substeps of mixing and wiping may be repeated two (2) to approximately four (4) times.

Manufacturing process 20 includes the steps of screening 28 and aging 30 of perchlorate-free pyrotechnic composition 16 for a period of time. Finally, manufacturing process 20 includes the steps of press consolidation 32 of perchlorate-free pyrotechnic composition 16.

This improved performance results from certain beneficial changes in the manufacturing process:

As illustrated in step 26, perchlorate-free pyrotechnic composition 16 is mixed for longer periods of time after adding the pre-blended sodium nitrate, barium nitrate and polyvinyl chloride ingredients to the binder coated magnesium fuel. In one embodiment, the sides of the mixing bowl are wiped with a non-sparking spatula during the course of the mixing process of step 26. For example, composition 16 is mixed for five minutes (5 min). This action may be followed by wiping the sides of the mixing bowl with a non-sparking spatula. The substeps of mixing and wiping may be repeated two (2) to approximately four (4) times. This leads to a more homogeneous mixture and seems to be an illustrative change in terms of improved performance.

As illustrated in step 28 of FIG. 3, perchlorate-free pyrotechnic composition 16 is screened 28 through a Standard No. 16 sieve after mixing step 26, and prior to press consolidation step 32. In this illustrative embodiment, the sieve serves to remove from perchlorate-free pyrotechnic composition 16 any clumps larger than approximately 0.9 millimeter which would be expected to be binder rich and would lead to a less homogeneous mixture if the larger clumps are included.

Perchlorate-free pyrotechnic composition 16 is allowed to age 30 for at least approximately three hours to approximately four hours after being mixed 26 and before being press consolidated 32 into flare candles 10. Perchlorate-free pyrotechnic compositions 16 are allowed to age 30 overnight and are found to be in an uncured state and in a readily pressable condition. In one embodiment, the composition is batched in five hundred grams (500 g) units for overnight aging 30. It is likely that this aging step 30 permits any heat and/or gaseous products that are liberated when the two binder components are mixed 26 to be dissipated prior to press consolidation step 32.

The press consolidation pressure 32 is increased from approximately eight thousand pounds (8,000 lbs) dead load to approximately nine thousand pounds (9,000 lbs) dead load.

An advantage over the earlier versions of these yellow signal flares is that compositions 16 do not include environmentally objectionable perchlorate ingredients. All of these colored flares give comparable or somewhat improved performance including their general appearance, candlepower luminous intensity, burn time, dominant wavelength, and color purity. This should ensure that these perchlorate-free colored signal flare compositions continue to meet or exceed all of the performance parameters included in the flare performance specifications for the yellow signal flares.

Another advantage is that elimination of the perchlorate oxidizer from these yellow compositions was determined not to have significantly increased the ignition sensitivity of these compositions to impact, rotary friction or electrostatic stimuli. This reduces the potential for an accidental initiation of a signal flare. Table 7 is included to compare the measured ignition sensitivities of the in-service and perchlorate-free colored signal flare compositions, as well as to explain the classification criteria used during this sensitivity testing. It is noted that excessively high ignition sensitivity can often be mitigated by substituting coarser fuel particles, as well as by either increasing the binder percentage of the composition, or by carrying out a separate binder pre-coating step of electrostatic and friction sensitive fine particle fuels. Accordingly, it is observed that the friction sensitivity of compositions including 7% of epoxy binder is beneficially improved when compared to the corresponding friction sensitivities of the compositions with 5% and 6% of epoxy binder. It is noted that this strategy was also effective in increasing the burn time of the signal flares.

TABLE 7

Ignition Sensitivities of In-Service and Perchlorate-Free Yellow Signal Flare Compositions

| | Impact Sensitivity | | Friction Sensitivity | | Electrostatic Sensitivity | |
|---|---|---|---|---|---|---|
| | 50% fire | | Energy (ft-lb) | | | Maximum No Fire |
| Sample | Height (cm) | Energy (J) | Average | Lowest | Response | Energy (Joules |
| IS Y 2 Yellow Standard | 174.45 | 34.19 | 611.47 | 191.40 | 90% Fired | 0.180 |
| YSF-1 | 172.71 | 33.85 | 750.03 | 266.41 | 90% Fired | 0.200 |
| YSF-3 | 176.35 | 34.56 | 1152.60 | 109.06 | 70% Fired | 0.800 |
| YSF-8 | 178.40 | 34.97 | 730.75 | 188.73 | 70% Fired | 1.250 |

Classification Criteria

The following table represents the energy levels required to classify a material with respect to its sensitivity to various forms of external energy input.

| | Impact 50% fire | | | |
|---|---|---|---|---|
| Sensitivity Level | height (cm) | energy (Joule) | Friction (Foot-pound) | Electrostatic (Joule) |
| Dangerous | <10 | <1.96 | <30 | <0.01 |
| High | <32 | <6.27 | <100 | <1.0 |
| Moderate | <100 | <19.6 | <500 | <10.0 |
| Low | <159 | <31.16 | <1000 | <25.0 |
| Very Low | <50% fires at 159 cm/31.16 Joule | | >1000 | >25.0 |
| Non-reactive | No energetic reactions observed at upper limit of apparatus being used. | | | |

The perchlorate-free yellow compositions have the added advantages of appearing more yellow as opposed to the yellow-orange appearance of the in-service IS Y 2 flare plumes. Also, the compositions either drastically reduce or completely eliminate the toxic cyanide salt combustion products (HCN, NaCN, and KCN) of the in-service IS Y 2 composition.

Of the perchlorate-free yellow compositions, the YSF-8 is an embodiment. The YSF-8 is seen in the above tables to produce the highest luminous intensity and is predicted to produce zero cyanide salt combustion products. It also had the closest match in burn times to that of the in-service IS Y 2 yellow flare composition. However, if necessary, the burn times could easily be matched more closely by using a slightly lower percentage of Granulation 15 magnesium together with a correspondingly higher percentage of Granulation 18 magnesium in the YSF-8 composition.

Some alternatives in the present invention have been alluded to above and should be obvious to one skilled in the art. For example, the ingredient percentages may be modified in order to tailor the burn rate and cause the signal flares to burn for a longer or shorter time. The percentage and the particle size distribution of metallic fuels may also be modified in order to make the composition more or less sensitive to accidental initiation by impact, rotary friction, or electrostatic stimuli, as well as to tailor its burn rate. The choice of the binder system as well as its weight percentage in the composition is also known by one skilled in the art to affect both the ignition sensitivity and the burn rate of the signal flare compositions.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of producing a flare composition, the method comprising the steps of:

mixing magnesium within the range of approximately eighteen weight percent (18%) to approximately thirty weight percent (30%) of the composition and a two-part curable binder system within the range of approximately four weight percent (4%) to approximately seven point five weight percent (7.5%) of the composition, wherein magnesium includes particles sizes selected from the group consisting of granulation 15, granulation 17, granulation 18, and mixtures thereof, wherein the binder system includes within the range of approximately seventy percent (70%) to approximately eighty percent (80%) epoxy and within the range of approximately twenty percent (20%) to approximately thirty percent (30%) curing agent, blending sodium nitrate within the range of approximately eighteen weight percent (18%) to approximately thirty-eight weight percent (38%) of the composition, barium nitrate within the range of approximately twenty-six weight percent (26%) to approximately thirty-six weight percent (36%) of the composition, and polyvinyl chloride within the range of approximately seven weight percent (7%) to approximately twelve weight percent (12%) of the composition, mixing the sodium nitrate, barium nitrate, and polyvinyl chloride mixture to the binder system coated magnesium mixture in a mixing bowl to provide the composition, wiping the sides of the mixing bowl, screening the composition, aging the composition for a period of time, and pressing the composition into the flare composition.

2. The method of claim 1 wherein the period of time is at least approximately three hours.

3. The method of claim 1 wherein the step of pressing the composition includes a press consolidation pressure of at least approximately eight thousand pounds (8,000 lbs) dead load.

4. The method of claim 3 wherein the press consolidation pressure is at least approximately nine thousand pounds (9,000lbs) dead load.

5. The method of claim 1, wherein the composition excludes perchlorate and calcium nitrate.

6. The method of claim 1 wherein the wiping step includes wiping the sides of the mixing bowl with a non-sparking spatula.

7. The method of claim 1 wherein the screening step includes screening the composition through a Standard No. 16 sieve.

* * * * *